US010940708B2

(12) United States Patent
Fort Filgueira et al.

(10) Patent No.: US 10,940,708 B2
(45) Date of Patent: Mar. 9, 2021

(54) SUBSTRATE SELECTION METHODS

(71) Applicant: HEWLETT-PACKARD DEVELOPMENT COMPANY, L.P., Spring, TX (US)

(72) Inventors: Aleix Fort Filgueira, Sant Cugat del Valles (ES); Antonio Gracia Verdugo, Sant Cugat del Valles (ES); Carles Flotats Villagrasa, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/492,991

(22) PCT Filed: Sep. 27, 2017

(86) PCT No.: PCT/US2017/053815
§ 371 (c)(1),
(2) Date: Sep. 11, 2019

(87) PCT Pub. No.: WO2019/066818
PCT Pub. Date: Apr. 4, 2019

(65) Prior Publication Data

US 2020/0215831 A1 Jul. 9, 2020

(51) Int. Cl.

| | |
|---|---|
| ***B41J 11/00*** | (2006.01) |
| ***B41J 15/04*** | (2006.01) |
| ***B41J 13/10*** | (2006.01) |
| ***B65H 23/185*** | (2006.01) |

(Continued)

(52) U.S. Cl.
CPC ..... *B41J 15/042* (2013.01); *B41J 11/009* (2013.01); *B41J 13/103* (2013.01); *B41J 15/04* (2013.01); *B41J 29/393* (2013.01); *B65H 23/185* (2013.01); *B65H 23/192* (2013.01)

(58) Field of Classification Search
CPC ..... B41J 11/009; B41J 13/103; B41J 15/04; B41J 15/042; B41J 29/393; B65H 23/185; B65H 23/192
See application file for complete search history.

(56) References Cited

U.S. PATENT DOCUMENTS

| | | | |
|---|---|---|---|
| 5,053,826 | A | 10/1991 | Castelli et al. |
| 7,728,992 | B2 | 6/2010 | Yamamoto et al. |
| 8,412,062 | B2 | 4/2013 | Kielland |

(Continued)

OTHER PUBLICATIONS

Making Changes to Printer Driver Settings, Feb. 1, 2001, <https://files.support.epson.com/htmldocs/ss25__/ss25__u1/softm_2.htm>.

*Primary Examiner* — Anh T Vo
(74) *Attorney, Agent, or Firm* — HP Inc. Patent Department

(57) ABSTRACT

It is disclosed a substrate selection method wherein the printer comprises a feeding mechanism including a feeding roller to receive a substrate roll and a media advance roller to receive a substrate from the substrate roll, the method comprising: actuating the feeding roller or the media advance roller; measuring a feeding mechanism parameter on the feeding roller or the media advance roller; calculating a substrate parameter in view of the feeding mechanism parameter; determining from a table a substrate type of in view of the substrate parameter; and selecting a preset on the printer in view of the substrate type.

9 Claims, 5 Drawing Sheets

(51) Int. Cl.
*B65H 23/192* (2006.01)
*B41J 29/393* (2006.01)

(56) References Cited

U.S. PATENT DOCUMENTS

| | | | | |
|---|---|---|---|---|
| 9,334,137 | B2 | 5/2016 | Igarashi et al. | |
| 2003/0122297 | A1 | 7/2003 | Youn | |
| 2004/0080551 | A1* | 4/2004 | Nunokawa | B41J 29/393 347/5 |
| 2004/0165023 | A1* | 8/2004 | Kang | B41J 11/42 347/16 |
| 2009/0016797 | A1 | 1/2009 | Brugue et al. | |
| 2009/0121423 | A1* | 5/2009 | Nakamura | B65H 16/028 271/275 |
| 2009/0136246 | A1 | 5/2009 | Murakami | |
| 2010/0150580 | A1* | 6/2010 | Brumbaugh | B41J 29/02 399/16 |

* cited by examiner

SUBSTRATE SELECTION METHODS

BACKGROUND

Printers are, in general terms, devices that modify the composition of a substrate as to incorporate an image. In particular, ink-based printers are fluid ejection devices that transfer ink from a storage to form an image on the substrate. In all printing technologies substrate management is a relevant aspect as, depending on the type of substrate to use, printing and handling parameters are set on the printer. Also, depending on the type of substrate to use, specific pieces of hardware may be used on the printing system to ensure an appropriate impression.

BRIEF DESCRIPTION OF THE DRAWINGS

Examples will now be described, by way of non-limiting example only, with reference to the accompanying drawings, in which.

DETAILED DESCRIPTION

Printing systems may be used to print different types of substrates. For each particular type of substrate the printer parameters may be changed to provide for an adequate quality level.

For example, printer parameters can include tension on the substrate throughout the printing process, the amount of print fluid to use in a swath the suction on the print zone, or may be parameters suggesting the use of additional printing accessories, such as absorbent materials below the substrate in case of textile substrates or substrates with high ink absorption.

In cases wherein an additional accessory is needed the setting of the parameter may include prompting a message to the user indicating the need to use such accessory.

Figure 1:
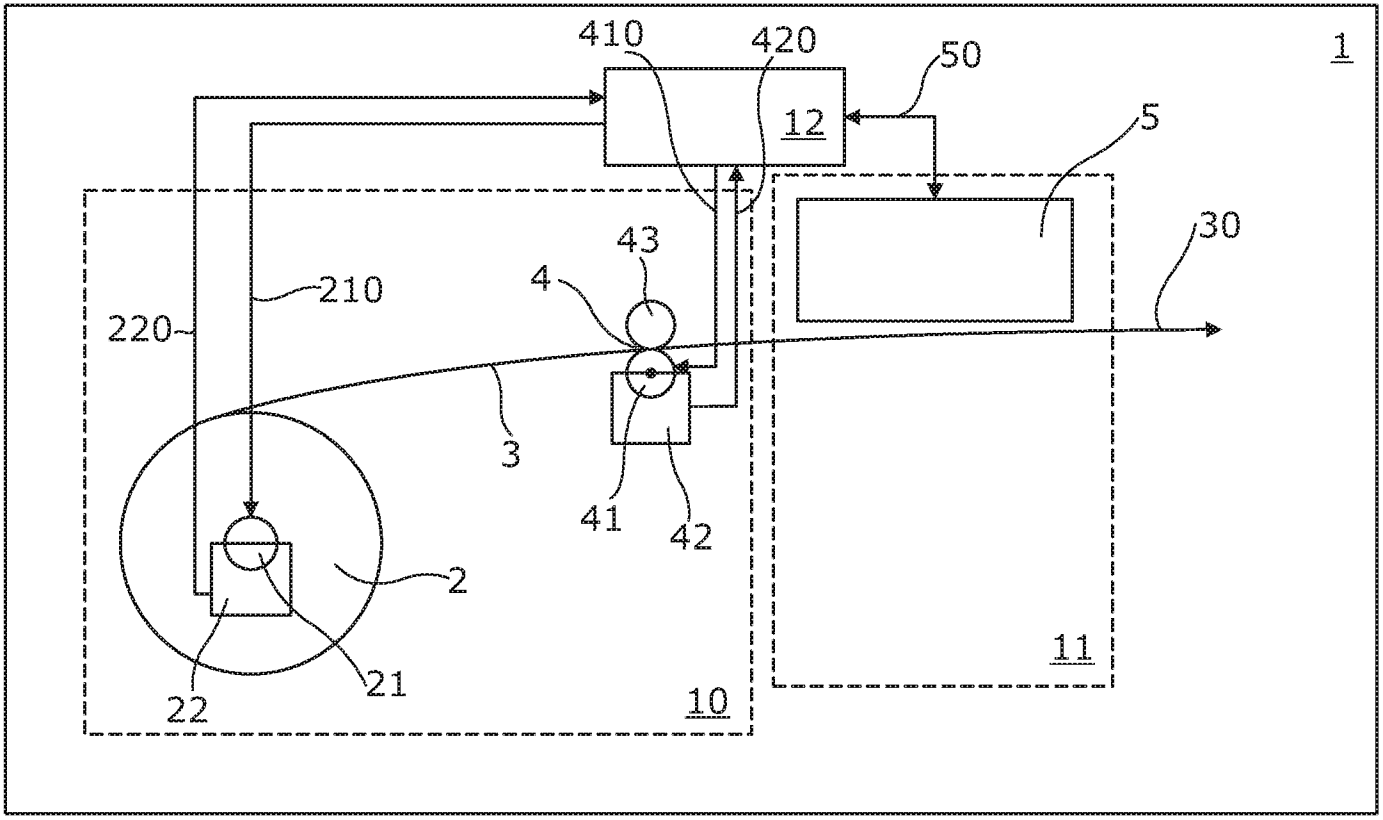
FIG. 1 shows a schematic view of a printing system according to an example.

FIG. 1 shows an example of a printing system 1 comprising a feeding mechanism 10 for feeding a substrate 3 from a substrate roll 2 to a print zone 11 of the printing system 1 and a printhead 5 wherein, after processing by the printhead 5, a printed substrate 30 is obtained.

As mentioned above, the function of the feeding mechanism 10 is to manage the feeding of the substrate 3 from its loading wherein it is provided in the form of a substrate roll 2 until it is fed to the print zone 11. The example feeding mechanism 10 of FIG. 1 comprises a feeding roller 21 wherein the substrate roll 2 is provided, the feeding roller 21 may comprise a motor which speed is controllable and an encoder 22 to provide the system with the angular position and/or velocity of the feeding roller 21.

Further, the feeding mechanism 10 of FIG. 1 comprises a media advance mechanism 4 comprising a pair of media advance rollers 41, 43 being at least one of them powered by a motor and comprising an encoder 42 to determine its position and/or speed. The media advance mechanism 4 is adapted to receive a substrate 3 sheet and it pulls the substrate from the substrate roll 2 as to feed it towards the print zone 11. In an example, the feeding roller 21 may be configured to maintain a constant tension on the substrate 3 by acting upon the substrate 3 with a force in a direction opposite to the pulling direction of the media advance mechanism 4.

In an example, a controller 12 is provided in the printing system wherein such controller may issue a first command signal 210 to control the motor associated to the feeding roller 21 and/or a second command signal 410 to control the motor associated to the media advance mechanism 4. Further, the controller 5 may receive a feeding roller signal 220 from the feeding roller encoder 22, that signal may be associated, for example, to the angular position of the feeding roller 21 and/or the current speed of the feeding roller 21. Likewise, the controller 5 may receive a media advance signal 420 originated from the media advance encoder 42 associated to the media advance mechanism 4 that may be related to the angular position and/or speed of at least one of the media advance rollers 41, 43. Also, the controller 12 may further be used to control parameters in the printhead 5 (such as ink amount or swath) so it has a bidirectional communication link 50 with the printhead 5.

A controller is considered, within the context of this disclosure, as any device comprising a processor and a memory being the processor configured to execute a set of instructions in view of an input (that may be stored in the memory) and issue an actuation signal.

In an example, the feed roller encoder 22 and/or the media advance encoder 42 may be used for determining parameters of the substrate 30, e.g., the angular position of the rollers may be used for determining the thickness of the substrate, as will be explained in more detail by making reference to FIG. 2. Also, the speed of the rollers may be used for estimating an inertia of the substrate roll 2, which is an indication of its mass as will be explained in more detail with reference to FIGS. 3, 4A and 4B.

The information from the encoders can, therefore, be used to determine the feeding mechanism parameters, such as angular position or speed and those feeding mechanism parameters may, in turn, be used to calculate (or, at least, estimate) substrate parameters, such as thickness or mass. The substrate parameters can be used also to identify a type of substrate that is loaded on the printing system and such identification may be used to select parameters on the printing system or a set of preset parameters.

In an example, the controller may access a look up table wherein a set of substrate parameters (such as thickness and/or mass) correspond to a determined type of substrate 3 and, for each type of substrate a set of parameters are established. In this manner, upon detection of a substrate type, the controller 12 may preset several parameters of the printing system which may be, for example, swath, substrate tension, ink quantity to use, print zone suction or may issue alerts to the user indicating the need to use some specific accessories of the printing system, such as, an absorbent below the substrate, a post processing station, a curing station, etc. In the context of the present disclosure, swath is to be understood as the width of each line of print fluid used in a printing pass.

In an example, the substrate parameters may be roughly estimated as there may be no need to identify the properties of a substrate 3 in much detail. In a particular example, the substrate determination needs to differentiate between a paper and a textile, since the mass differences are so big, a rough estimation of the mass may be enough to determine the preset conditions for the substrate 3.

Figure 2:
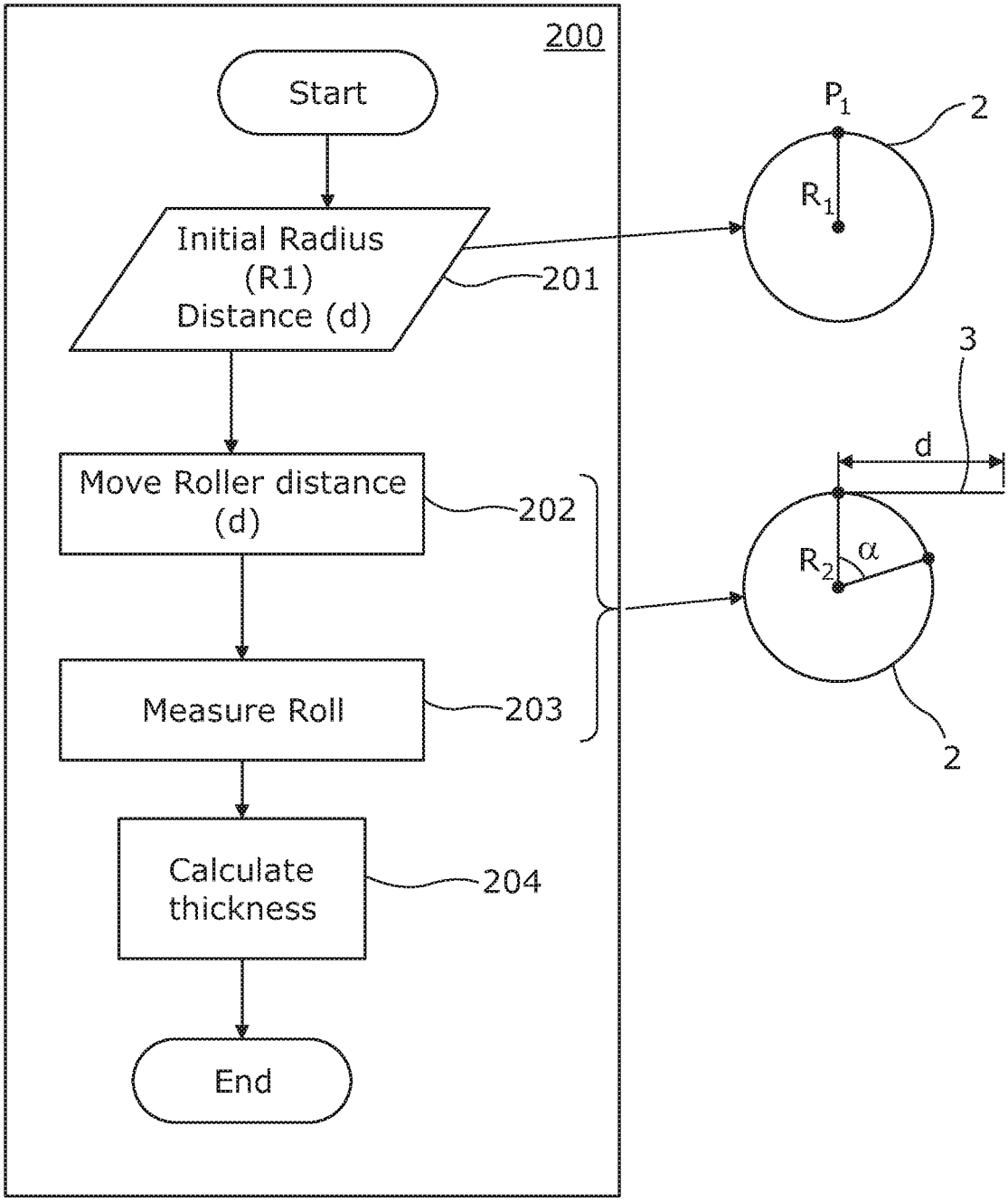
FIG. 2 shows a flow diagram of a method for calculating thickness as a substrate parameter in view of a feeding parameter according to an example.

FIG. 2 shows a flow diagram 200 wherein a pair of encoders may be used to determine the thickness of a substrate roll 2. Initially, an initial radius ($R_1$) of the substrate roll 2 is established and a distance (d) is selected 201, the first radius ($R_1$) may be a previously known radius, e.g., a previously measured radius and the distance (d) may be a pre-determined length of substrate to perform the thickness calculation.

Then, one of the rollers, for example, one of the rollers from the media advance mechanism 4 is actuated 202 and the substrate roll 2 is pulled by a length of substrate 3 corresponding to the distance d, such length may be measured by the media advance encoder 42.

Subsequently, the angular position ($\alpha$) of the feeding roller 21 is measured 203, e.g., by means of the feeding roller encoder 22. Since a determined amount of substrate 3 has been withdrawn from the substrate roll 2, its radius has now changed to a new radius ($R_2$). Such radius can be easily calculated given that the angular position ($\alpha$) was measured and the arc for such angular position ($\alpha$) is substantially the distance (d) of substrate 3 withdrawn from the substrate roll 2. Then, the new radius ($R_2$) may be estimated by the equation:

$$R_2 = \frac{d}{\alpha[rad]}$$

Finally the thickness is estimated 204 in view of such radius. In particular the thickness of the substrate 3 is proportional to the difference between the initial radius ($R_1$) and the new radius ($R_2$).

Figure 3:
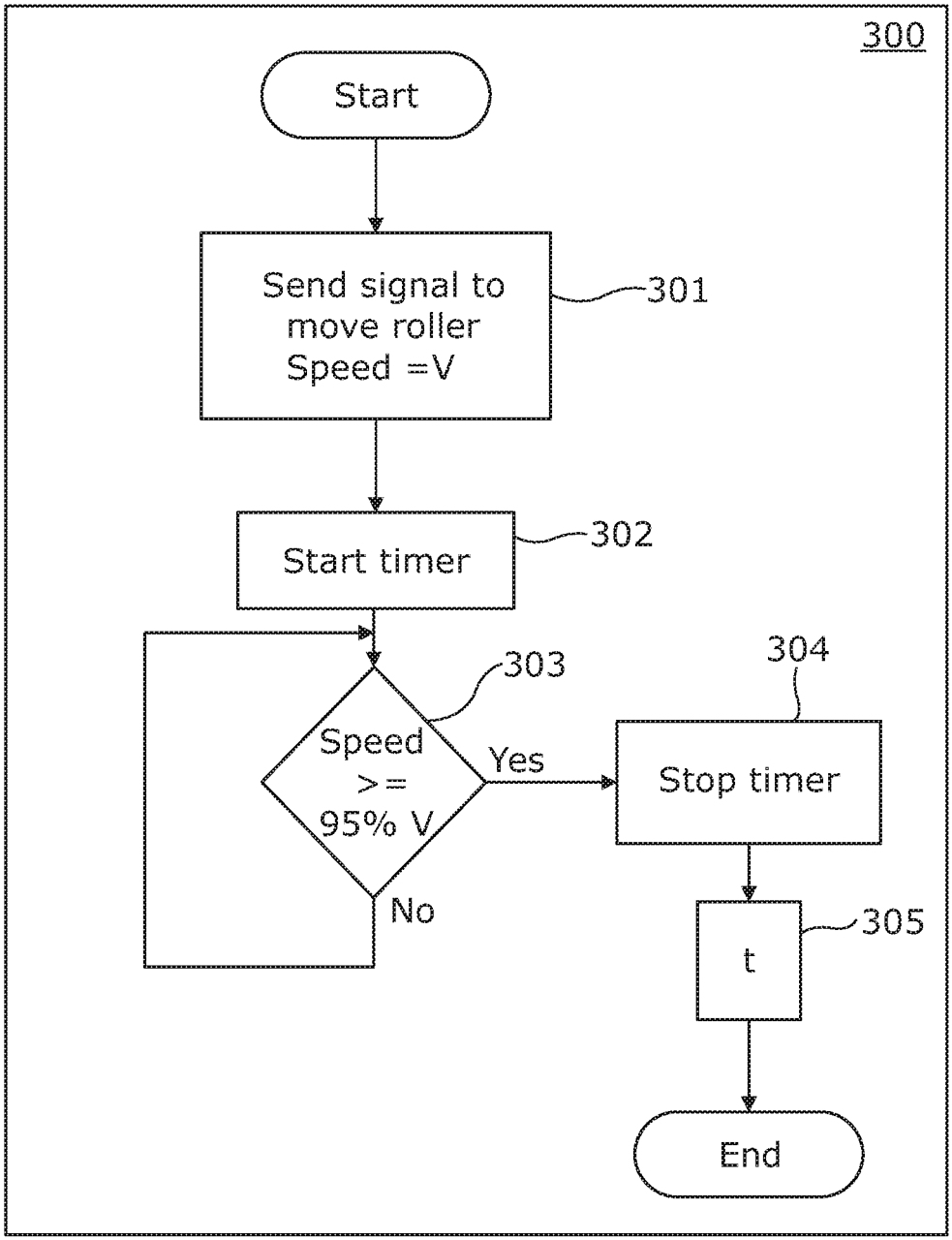
FIG. 3 shows a flow diagram of a method for calculating inertia as a substrate parameter in view of a feeding parameter according to an example.

FIG. 3 shows a flow diagram 300 wherein a roller may be used to estimate the inertia as substrate parameter. In the example of FIG. 3 a roller, for example, the feeding roller 21 may be used. In this example, the controller 12 issues a command signal to the motor 301 so that the feeding roller 21 is moved to a determined speed (V). This speed may be controlled, e.g., by pulse width modulation.

Then, a timer is started 302 and the speed increases. A decision block 303 determines if the speed has reached a stabilization speed, e.g., 95% of the determined speed (V). If it has not reached this stabilization speed, the timer is maintained and, if it reaches the stabilization speed the timer is stopped 304. As a result a time is obtained 305 wherein this time to reach the stabilization speed is related to the inertia of the substrate roll 2 as will be explained in more detail with reference to FIGS. 4A and 4B.

Figure 4A:
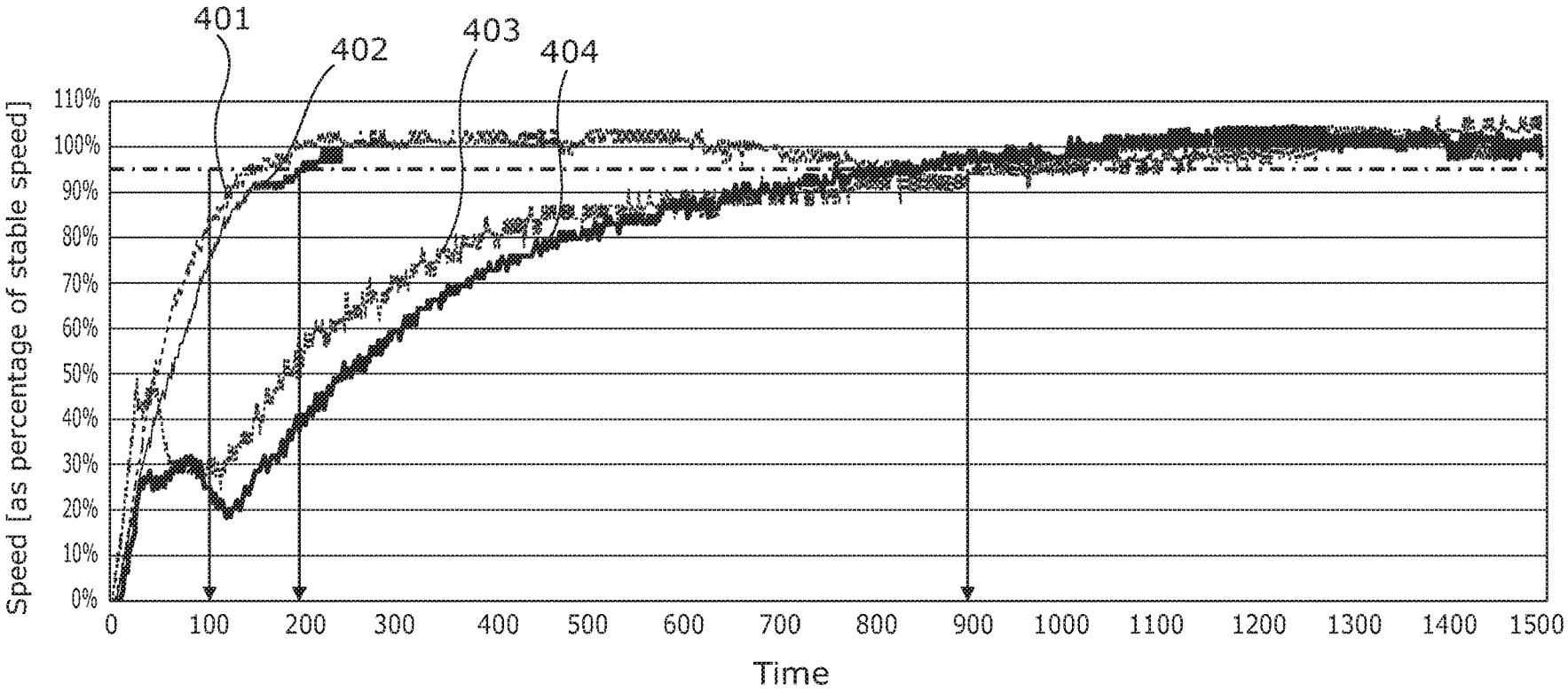
FIG. 4A shows a graph identifying the stabilization speed for different substrate rolls according to an example.

FIG. 4A shows a graph that shows the stabilization speed for different substrates 3. In particular, a condition 401 with a textile moved by a roller at 24V, another condition 402 wherein the textile of the first condition is moved by a roller at 15V, a third condition 403 wherein a banner is moved by a roller at 24V and a fourth condition 404 wherein the banner of the third condition is moved by a roller at 15V.

From FIG. 4A it can be seen that, although the nominal speeds of the roller are different (a 24V fed rolled is faster than a 15V fed roller) the stabilization time as 95% of the final speed is very similar. Therefore, an estimation of the inertia based on such measurements can be considered to be robust to the nominal speeds of the rollers, i.e., of the type of roller to use in the printing system.

For these examples, the stabilization speed is considered to be a speed of about 95% of the setting speed issued by the controller 12. Nonetheless, as can be seen from the graph, other percentages may also provide similar results, in particular, the range from 80% to 100% of the setting speed.

Also, FIG. 4A shows that a rough estimation of the inertia may be enough to differentiate between a textile and a banner. Also, the printing parameters are different between these two types of substrates. On the other hand, some of the printing parameters amongst textiles may be similar so this rough estimation may be enough to establish at least some of the preset parameters.

Figure 4B:
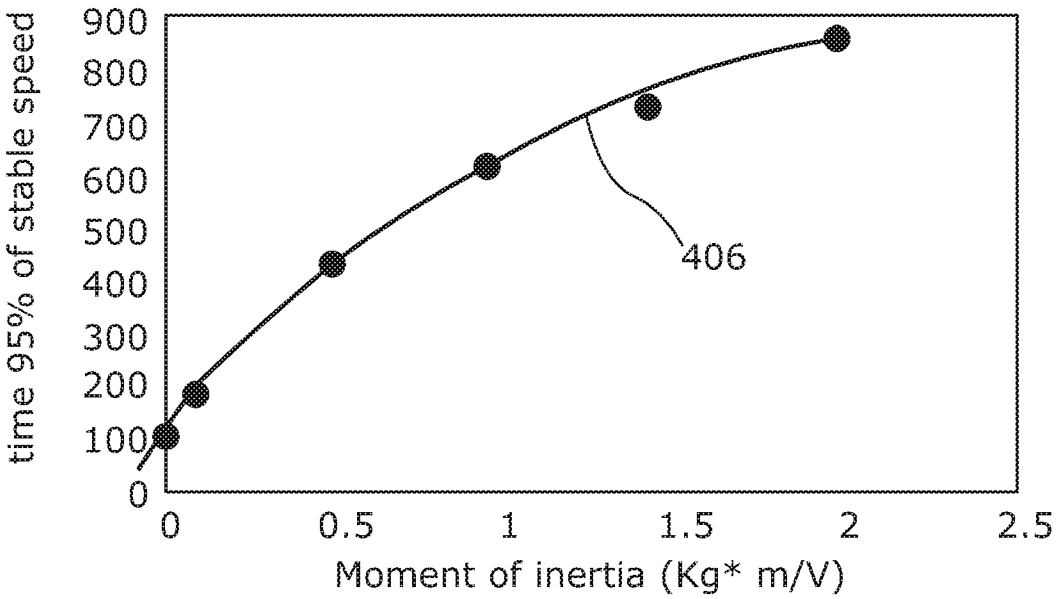
FIG. 4B shows a graph that correlates stabilization speed with inertia or a substrate roll according to an example.

FIG. 4B shows a graph wherein the stabilization speed has been correlated to the moment of inertia of the substrate roll 2. The function 406 may be used to calculate the current inertia of the substrate roll 2 to establish the preset to use and, alternatively, provide the user with information about the substrate being used in a printing process.

The thickness of the substrate 3 and the inertia of the substrate roll 2 are examples of substrate parameters that may be obtained by using existing elements within the print system, such as encoders to determine properties of the substrate. Either one of them may be useful to establish or, at least, estimate the type of substrate that is being loaded to the printing system. In a particular example, both of such parameters are estimated and the type of substrate is determined by the controller 12 by identifying in a look-up table the type of substrate on the look-up table that is more similar in view of the estimated substrate parameters. Then the preset parameters configured on the look-up table for such substrate are used throughout the printing process.

In essence, the look-up table comprises preset parameters and a set of substrate parameters. The printing system may select, depending the set of substrate parameters estimated, the preset to be used by the printing system.

In an example, the determination of the preset to use may be determined by using the expression:

$$\Delta = a_1(x_1-y_1)^2 + a_2(x_2-y_2)^2 + \ldots + a_n(x_n-y_n)^2;$$

wherein $a_1$, $a_2$, $a_n$ correspond to a weighing constant to determine the hierarchy of the substrate parameters, $x_1$, $x_2$, $x_n$ correspond to the substrate parameters on the look-up table and $y_1$, $y_2$, $y_n$ correspond to the measured (or estimated) substrate parameters. The preset value to select would be the preset that has the lowest value of $\Delta$.

In particular, it is disclosed a substrate selection method for a printer wherein the printer comprises a feeding mechanism including a feeding roller to receive a substrate roll and a media advance roller to receive a substrate from the substrate roll, the method comprising:

- actuating the feeding roller or the media advance roller;
- measuring a feeding mechanism parameter on the feeding roller or the media advance roller;
- calculating a substrate parameter in view of the feeding mechanism parameter;
- determining from a table a substrate type of in view of the substrate parameter; and
- selecting a preset on the printer in view of the substrate type.

The feeding mechanism parameter may be, e.g., the angular displacement of the media advance roller and/or the feeding roller. In an example, the feeding mechanism parameter is the rotational speed of the media advance roller and/or the feeding roller. Additionally, the feeding mechanism parameter is one of the voltage, current or power on a motor connected to the media advance roller and/or the feeding roller. Further, the method may be performed using more than one feeding parameter, e.g., both, the angular position and the rotational speed of either one or both rollers.

In an example, the media advance roller and/or the feeding roller are actuated to rotate a determined angle. The angle may be an angle calculated to pull from the substrate roll a determined length or distance of substrate.

Additionally, the feeding mechanism parameter may be the angular displacement of the media advance roller and/or the feeding roller.

Furthermore, actuating the feeding roller or the media advance roller may comprise sending an actuation signal to a motor to actuate at a configured speed. In this case, the feeding mechanism parameter may be, e.g., the time from the send of the actuation signal until the motor reaches a determined percentage of the configured speed. As explained above, this time to reach the stability speed is a function of the inertia of the substrate roll. The percentage of the configured speed (or, the stabilization speed) is, in an example, a percentage in the range from 80% to 100% of the configured speed.

The preset of the printer may comprise setting parameters such as, for example: swath, ink quantity, print zone suction, and/or substrate tension.

Also, a printing system is disclosed, wherein such system comprises:

a feeding mechanism adapted to feed a substrate from a substrate roll to a print zone;

a printhead located in the print zone; and a controller wherein the feeding mechanism comprises a set of rollers being the controller connected to an encoder of the feeding mechanism and to correlate a signal received from the encoder to a substrate type.

The controller of the system may be to correlate the signal from the encoder to a substrate type by using a look up table.

Further, the controller may be to determine a print parameter on response to the correlation to a substrate type.

As mentioned above, print parameters can be at least one selected from: swath, ink quantity, print zone suction, and/or substrate tension.

In an example, the signal received from the encoder is the angular position of a roller and/or the speed of a roller.

The invention claimed is:

1. A substrate selection method for a printer wherein the printer comprises a feeding mechanism including a feeding roller to receive a substrate roll and a media advance roller to receive a substrate from the substrate roll, the method comprising:

actuating the feeding roller or the media advance roller;

measuring a feeding mechanism parameter on the feeding roller or the media advance roller;

calculating a substrate parameter in view of the feeding mechanism parameter;

determining from a table a substrate type of in view of the substrate parameter; and selecting a preset on the printer in view of the substrate type.

2. The method of claim 1 wherein the feeding mechanism parameter is the angular displacement of the media advance roller and/or the feeding roller.

3. The method or claim 1 wherein the feeding mechanism parameter is the rotational speed of the media advance roller and/or the feeding roller.

4. The method of claim 1 wherein the feeding mechanism parameter is one of the voltage, current or power on a motor connected to the media advance roller and/or the feeding roller.

5. The method of claim 1 wherein the media advance roller and/or the feeding roller is actuated to rotate a determined angle.

6. The method of claim 1 wherein actuating the feeding roller or the media advance roller comprises sending an actuation signal to a motor to actuate at a configured speed.

7. The method of claim 6 wherein feeding mechanism parameter is the time from the send of the actuation signal until the motor reaches a determined percentage of the configured speed.

8. The method of claim 7 wherein the determined percentage of the configured speed is a percentage in the range between 80% and 100%.

9. The method of claim 1 wherein the preset of the printer comprises setting parameters for: swath, ink quantity, print zone suction, and/or substrate tension.

* * * * *